US009708140B2

(12) United States Patent
Seto et al.

(10) Patent No.: US 9,708,140 B2
(45) Date of Patent: Jul. 18, 2017

(54) SHEET FEEDING DEVICE AND IMAGE FORMING APPARATUS

(71) Applicants: Kazuki Seto, Kanagawa (JP); Kenji Hayasaka, Kanagawa (JP); Kazuki Morita, Kanagawa (JP); Tomoyuki Okada, Kanagawa (JP); Hisayoshi Sugawara, Kanagawa (JP)

(72) Inventors: Kazuki Seto, Kanagawa (JP); Kenji Hayasaka, Kanagawa (JP); Kazuki Morita, Kanagawa (JP); Tomoyuki Okada, Kanagawa (JP); Hisayoshi Sugawara, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/065,991

(22) Filed: Mar. 10, 2016

(65) Prior Publication Data

US 2016/0272443 A1 Sep. 22, 2016

(30) Foreign Application Priority Data

Mar. 19, 2015 (JP) ..... 2015-055691
Mar. 20, 2015 (JP) ..... 2015-057257

(51) Int. Cl.
*B65H 9/00* (2006.01)
*B65H 1/04* (2006.01)

(52) U.S. Cl.
CPC ..... *B65H 1/04* (2013.01); *B65H 2402/441* (2013.01); *B65H 2402/442* (2013.01); *B65H 2405/115* (2013.01); *B65H 2405/1117* (2013.01); *B65H 2405/111646* (2013.01); *B65H 2407/22* (2013.01); *B65H 2601/25* (2013.01); *B65H 2801/39* (2013.01)

(58) Field of Classification Search
CPC .... B65H 2405/32; B65H 2405/111646; B65H 2405/1117; B65H 2405/115; B65H 2402/441; B65H 2402/442
See application file for complete search history.

(56) References Cited

U.S. PATENT DOCUMENTS 6,469,811 B1 10/2002 Tamura
7,748,700 B2 * 7/2010 Nishizawa ..... B65H 1/14 271/147
8,506,191 B2 * 8/2013 Yamamoto ..... B65H 3/44 400/691

FOREIGN PATENT DOCUMENTS

JP 06-298382 10/1994
JP 2000-128367 5/2000

* cited by examiner

*Primary Examiner* — Howard Sanders
(74) *Attorney, Agent, or Firm* — Harness, Dickey & Pierce, P.L.C.

(57) ABSTRACT

A sheet feeding device includes a tray main body and a cover member. The tray main body has a first mount surface. The cover member is rotatably connected to an end of the tray main body on the side opposite to the sheet feeding side so that the cover member can move rotationally between a closed position where the cover member covers the first mount surface and an open position where the first mount surface is exposed, and has a second mount surface on which a sheet is mounted over the first mount surface when cover member is in the open position. The cover member includes an opening for sheet insertion which penetrates through from an upper surface to a bottom surface of the cover member so that a sheet can be inserted onto the first mount surface when the cover member is in the closed position.

20 Claims, 9 Drawing Sheets

SHEET FEEDING DEVICE AND IMAGE FORMING APPARATUS

CROSS-REFERENCE TO RELATED APPLICATIONS

The present application claims priority to and incorporates by reference the entire contents of Japanese Patent Application No. 2015-055691 filed in Japan on Mar. 19, 2015 and Japanese Patent Application No. 2015-057257 filed in Japan on Mar. 20, 2015.

BACKGROUND OF THE INVENTION

1. Field of the Invention

The present invention relates to a sheet feeding device and an image forming apparatus including the sheet feeding device.

2. Description of the Related Art

Conventionally, there is known a sheet feeding device with a tray on which a sheet to be fed, such as an original or a sheet of paper on which an image is to be formed, is mounted so that the sheet can be fed from the end thereof; the tray is configured to be foldable according to the size of a sheet to be fed in a sheet feeding direction.

For example, Japanese Laid-open Patent Publication No. 2000-128367 and Japanese Laid-open Patent Publication No. H6-298382 have disclosed a foldable paper feeding tray that includes a tray main body and a cover member; the cover member is rotatably connected to the tray main body and can move rotationally between a closed position where the cover member covers a first mount surface of the tray main body and an open position where the first mount surface is exposed. At an edge of the tray main body on the side opposite to a sheet feeding side, hinge parts (connecting parts) are installed on both ends of the tray main body in a width direction perpendicular to a sheet feeding direction, respectively. The hinge parts have a rotating shaft installed on the side of the tray main body and a movable arm part capable of moving rotationally about the rotating shaft; the cover member is connected to the tip of the movable arm part. This cover member is supported by the movable arm parts of the hinge parts so that an edge of the cover member on the side of the rotation center is opposed to the edge of the tray main body through a predetermined gap (a sheet insertion slot) when the cover member has rotationally moved to the closed position where the cover member covers the first mount surface of the tray main body. A sheet can be inserted into this sheet insertion slot and mounted on the first mount surface of the tray main body. On the other hand, when the cover member has rotationally moved to the open position where the first mount surface of the tray main body is exposed, a large-size sheet can be mounted on over the first mount surface of the tray main body and an upper surface (a second mount surface) of the cover member.

In the paper feeding tray disclosed in any of Japanese Laid-open Patent Publication No. 2000-128367 and Japanese Laid-open Patent Publication No. H6-298382, it is necessary to form the sheet insertion slot composed of the predetermined gap between the tray main body and the cover member which are opposed to each other on the side opposite to the sheet feeding side of the tray main body. Therefore, the movable arm parts of the hinge parts supporting the cover member increase in length, thereby the rigidity of the hinge parts is low. If the rigidity of the hinge parts is low, when the cover member is rotationally moved to the open position where the first mount surface of the tray main body is exposed to hold large-size sheets on the first mount surface of the tray main body and the second mount surface of the cover member, the hinge parts may be damaged according to the load of the sheets.

In the paper feeding tray disclosed in Japanese Laid-open Patent Publication No. H6-298382, if it is used with the cover member in a closed state in which the cover member has rotationally moved to the closed position, when a sheet is inserted into the sheet insertion slot and is mounted on the first mount surface of the tray main body, the leading end of the sheet is hard to be seen. Therefore, the leading end of the sheet may possibly enter between an upper end of a side fence and the underside of the cover member, resulting in a sheet setting failure.

SUMMARY OF THE INVENTION

It is an object of the present invention to at least partially solve the problems in the conventional technology.

According to exemplary embodiments of the present invention, there is provided a sheet feeding device comprising: a tray main body that has a first mount surface on which a sheet to be fed in a predetermined direction is mounted; and a cover member that is rotatably connected to an end of the tray main body on the side opposite to the sheet feeding side so that the cover member is able to move rotationally between a closed position where the cover member covers the first mount surface of the tray main body and an open position where the first mount surface of the tray main body is exposed, and has a second mount surface on which a sheet to be fed is mounted over the first mount surface of the tray main body when cover member is in the open position, wherein the cover member includes an opening for sheet insertion which penetrates through from an upper surface to a bottom surface of the cover member so that a sheet is able to be inserted onto the first mount surface of the tray main body when the cover member is in the closed position.

Exemplary embodiments of the present invention also provide an image forming apparatus comprising: an original feeding unit that feeds an original; an image reading unit that reads an image of the original fed by the original feeding unit; and an image forming unit that forms an image on a recording medium on the basis of image data of the image read by the image reading unit, wherein the image forming apparatus comprises the above-described sheet feeding device as the original feeding unit.

Exemplary embodiments of the present invention also provide a sheet feeding device comprising: a tray main body that has a first mount surface on which a sheet to be fed in a predetermined direction is mounted; a cover member that is rotatably connected to an end of the tray main body on the side opposite to the sheet feeding side so that the cover member is able to move rotationally between a closed position where the cover member covers the first mount surface of the tray main body and an open position where the first mount surface of the tray main body is exposed, and has a second mount surface on which a sheet to be fed is mounted over the first mount surface of the tray when cover member is in the open position; an opening for sheet insertion through which a sheet is able to be inserted onto the first mount surface of the tray main body when the cover member is in the closed position; and a pair of side fences that controls movement of a sheet mounted on the first mount surface of the tray main body in a width direction perpendicular to a sheet feeding direction, wherein the cover member is formed so that at least part of both a pair of the side fences are exposed when the cover member is in the closed position.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 12A is a schematic diagram illustrating the inclination angle of an inclined surface according to the embodiment, and FIG. 12B is a schematic diagram illustrating the inclination angle of the inclined surface according to Modification 1;

DETAILED DESCRIPTION OF THE PREFERRED EMBODIMENTS

An exemplary embodiment of the present invention is described below.

Figure 1:
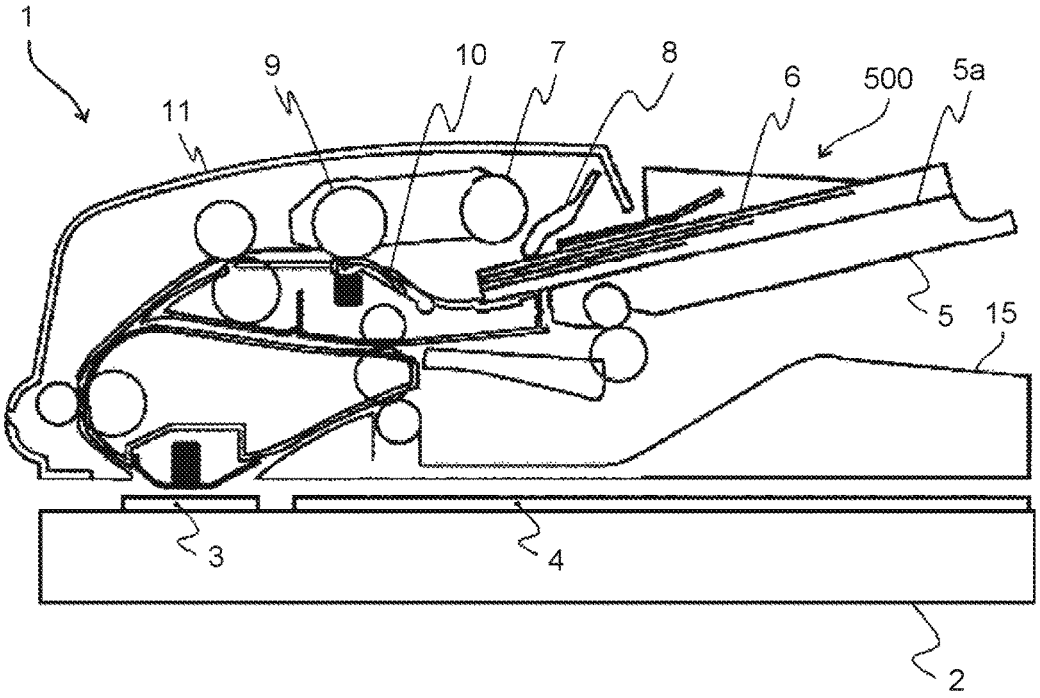
FIG. 1 is a schematic configuration diagram showing an example of an automatic document feeder as a sheet feeding device according to an embodiment of the present invention.

FIG. 1 is a schematic configuration diagram showing an example of an automatic document feeder (ADF) 1 as a sheet feeding device according to an embodiment of the present invention. In FIG. 1, the ADF 1 is installed openably on top of an image reading device 2 as an image reading unit such as a scanner so that the ADF 1 can be open and closed with a hinge or the like installed on the back side in FIG. 1 as a supporting point. The image reading device 2 is provided with a slit glass (a reading position) 3 and a contact glass 4 on the top surface thereof. The image reading device 2 causes the ADF 1 to convey one or more originals 6 as sheets set on a mount surface 5*a* as a first mount surface of a tray main body 5 of a paper feeding tray 500 with the image side of the originals 6 face up and let the originals 6 pass through over the slit glass 3, thereby reading the originals 6. Furthermore, the image reading device 2 can read an original set on the contact glass 4 with the image side of the original face down. The ADF 1 has two modes: single-sided reading mode and double-sided reading mode; either one of the reading modes can be selected according to an instruction issued through an operation unit such as an operation panel, and the operation of the ADF 1 is controlled according to the set reading mode.

Furthermore, the ADF 1 is provided with an openable and closable paper feeding cover 11 so as to cover an original conveying unit composed of members such as a pick-up roller 7, a set-original detection filler 8, a feed roller 9, and a separation pad 10. The pick-up roller 7 is arranged in the central part in a direction perpendicular to an original conveying direction, and normally waits at a predetermined distance from the tray main body 5. Then, when the set-original detection filler 8 has detected that the originals 6 have been set in the tray main body 5, and an instruction to start reading the originals has been issued through the operation unit, the pick-up roller 7 moves down from the waiting position to a contact position with the top surface of the originals 6. Then, the top one of the originals 6 is sequentially separated by the feed roller 9 and the separation pad 10 and conveyed one by one to the slit glass 3 where an image of each original is read. Incidentally, a reverse roller can be used instead of the separation pad 10.

Figure 2:
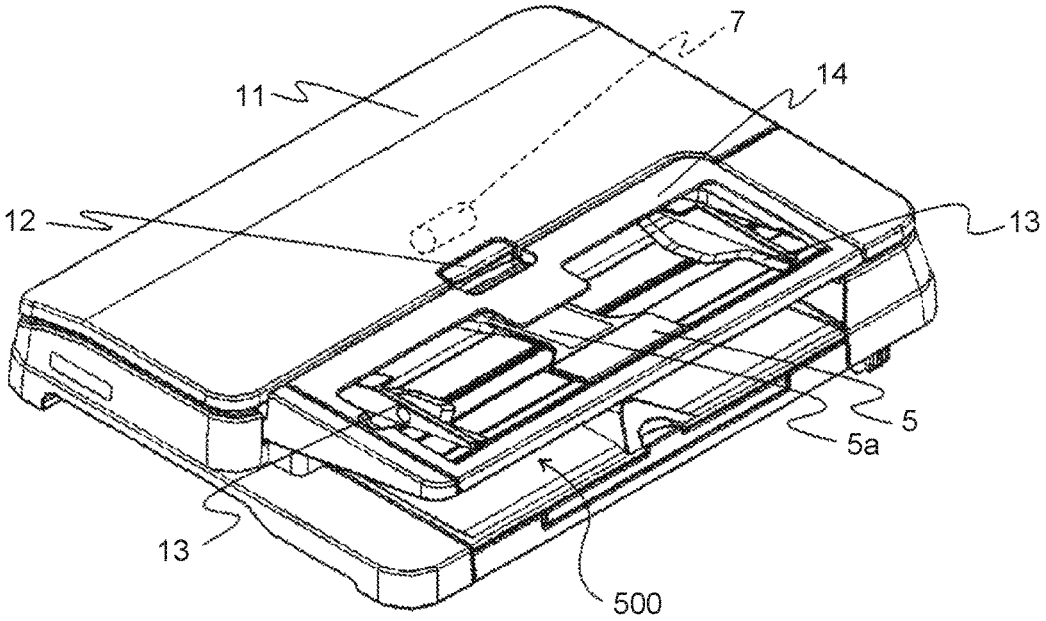
FIG. 2 is a perspective view showing an example of the automatic document feeder according to the present embodiment in a state in which a paper feeding cover is closed.
Figure 3:
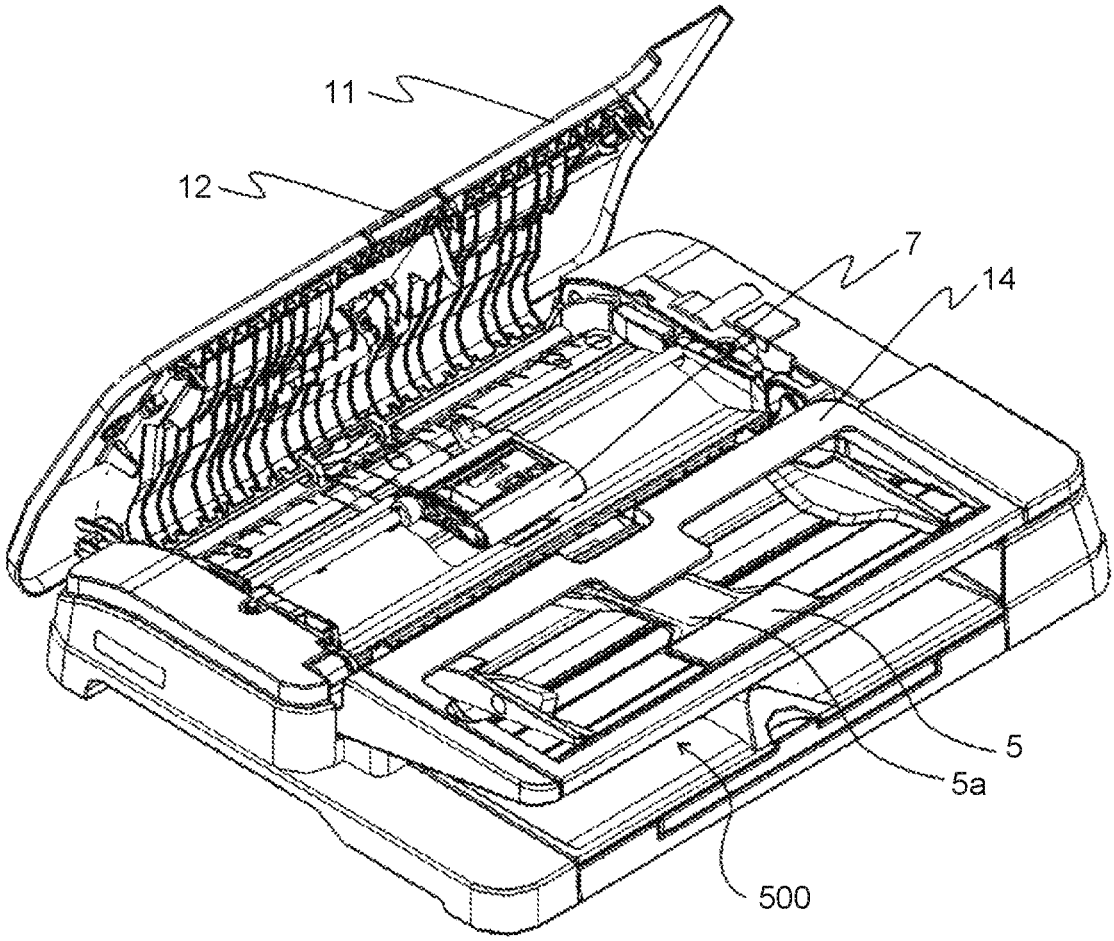
FIG. 3 is a perspective view showing an example of the automatic document feeder according to the present embodiment in a state in which the paper feeding cover is open.

FIG. 2 is a perspective view showing an example of the ADF 1 according to the present embodiment in a state in which the paper feeding cover 11 is closed. FIG. 3 is a perspective view showing an example of the ADF 1 according to the present embodiment in a state in which the paper feeding cover 11 is open.

In the ADF 1, rollers such as the pick-up roller 7 and the feed roller 9, the separation pad 10, etc. can be exposed when the paper feeding cover 11 is open. Therefore, if a paper jam or the like occurs while the ADF 1 is conveying originals, the paper feeding cover 11 is opened by operating a paper-feeding-cover handle 12 as shown in FIG. 3, thereby originals 6 in the ADF 1 can be easily removed.

Furthermore, as shown in FIG. 2, the tray main body 5 of the ADF 1 is provided with a pair of side fences 13 and an openable and closable cover member 14. The foldable paper feeding tray 500 with the tray main body 5, the side fences 13, and the cover member 14 is explained in detail below.

Figure 4:
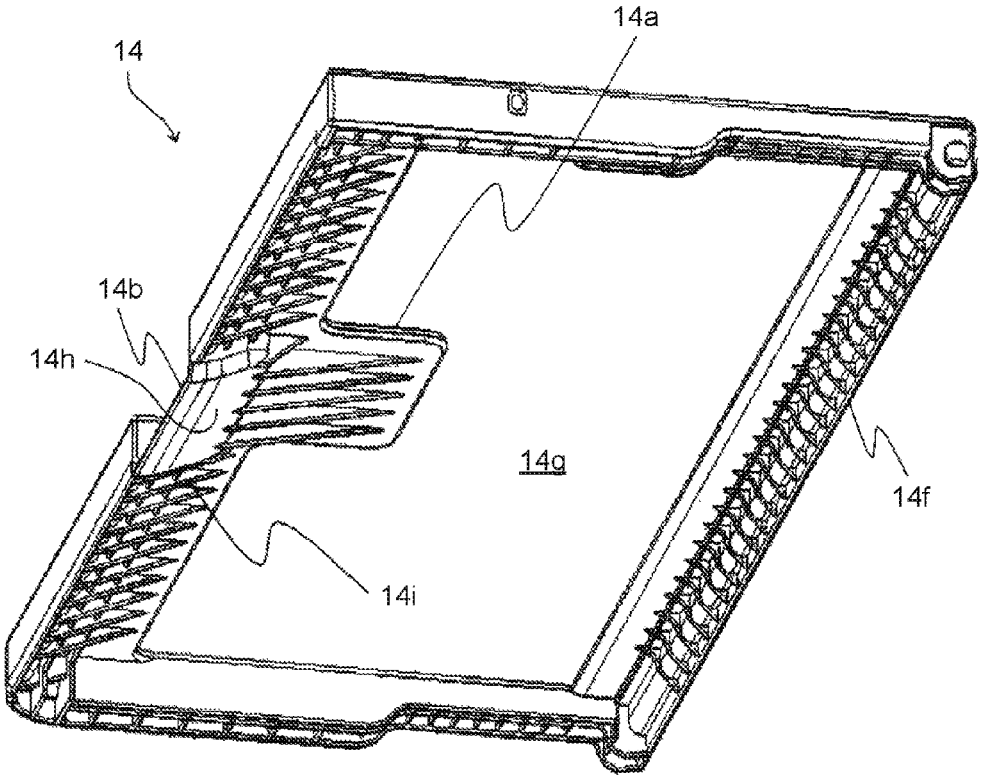
FIG. 4 is a perspective view showing an example of a cover member according to the present embodiment.
Figure 5:
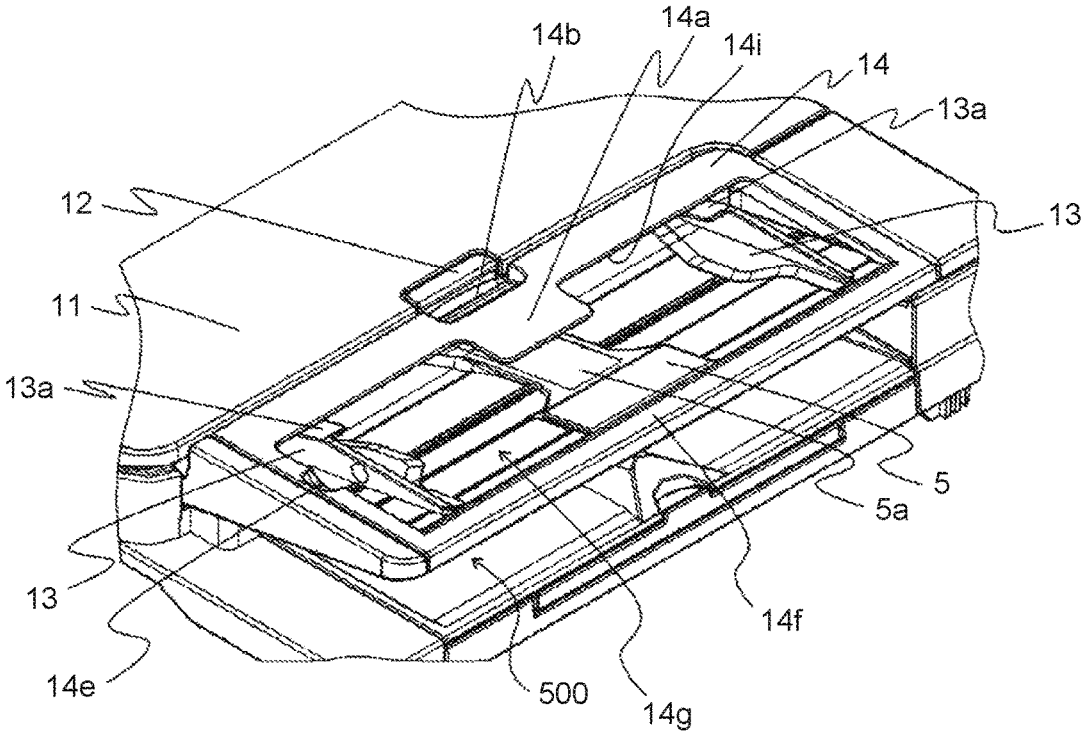
FIG. 5 is an enlarged perspective view of a portion near a paper feeding tray when the cover member of the automatic document feeder according to the present embodiment has moved rotationally to a closed position.
Figure 6:
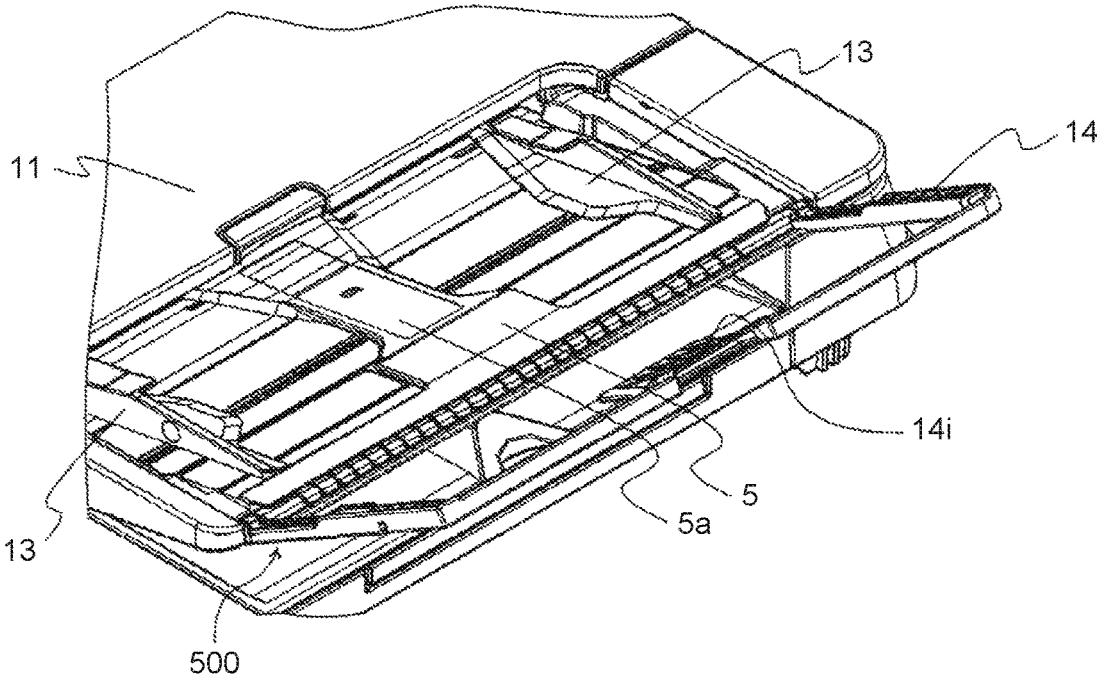
FIG. 6 is an enlarged perspective view of the portion near the paper feeding tray when the cover member of the automatic document feeder according to the present embodiment has moved rotationally to an open position.

FIG. 4 is a perspective view showing an example of a single piece of the cover member 14 according to the present embodiment. FIG. 5 is an enlarged perspective view of a portion near the paper feeding tray 500 when the cover member 14 of the ADF 1 according to the present embodiment has moved rotationally to a closed position. FIG. 6 is an enlarged perspective view of the portion near the paper feeding tray 500 when the cover member 14 of the ADF 1 according to the present embodiment has moved rotationally to an open position.

The cover member 14 is formed with an opening 14*g* for sheet insertion which penetrates through from an upper surface to a bottom surface of the cover member 14 so that originals 6 can be inserted into the tray main body 5 when the cover member 14 is in the closed position, and is openably and closably connected to the tray main body 5 by a connecting part 14*f*. Furthermore, the cover member 14 has a mount surface 14*i* as a second mount surface on the side opposite to the connecting part 14*f* across the opening 14*g*; this mount surface 14*i* has a first projecting portion 14*a* which serves as a mount surface on which originals 6 are mounted when the cover member 14 is in the open position.

As shown in FIG. 5, because of the opening 14*g* formed on the cover member 14, even when the cover member 14 is in the closed position, the visibility and operability of the tray main body 5 and a pair of the side fences 13 are ensured in terms of the usability.

A pair of the side fences 13 each have an upper guide part 13*a* for guiding sheets by pushing the ends of the sheets in their width direction from above so that even bent originals 6 can be set in the tray main body 5 certainly. Accordingly, the upper guide parts 13*a* can guide the upper side of the ends of the leading end of originals 6 in the width direction, and, even if the originals 6 are bent in the width direction and ends of the originals 6 in the width direction are curved up, can push the curve to such an extent that the originals 6 are not creased or not caught in the pick-up roller 7 when the originals 6 are being conveyed. Therefore, when the mount surface 5*a* is hidden by the cover member 14 located in the closed position and hard to be seen, without a user taking the trouble to check and smooth the curve of the ends of originals 6 in the width direction, the curve is pushed downward, so it is possible to prevent the originals 6 being fed and conveyed from being damaged or jammed.

Moreover, the opening 14*g* of the cover member 14 is formed so that at least the respective upper ends (the upper guide parts 13*a*) of a pair of the side fences 13 are always exposed. Accordingly, when originals 6 are set, none of the originals 6 accidentally enters between the cover member 14 and the upper guide parts 13*a*, and the originals 6 can be set in a correct position.

Incidentally, the upper guide parts 13*a* are provided on a pair of the side fences 13, respectively; however, the upper guide parts 13*a* can be provided independently of a pair of the side fences 13.

The first projecting portion 14*a* of the cover member 14 is formed so as to project toward the opening in the center of the cover member 14 out of the moving range of the upper guide parts 13*a* of a pair of the side fences 13. Accordingly, even when the upper guide parts 13*a* of a pair of the side fences 13 have moved, the upper guide parts 13*a* do not come in contact with the first projecting portion 14*a* of the cover member 14. Furthermore, the cover member 14 has a handle 14*b* for opening/closing the cover member 14 in a position opposed to the paper-feeding-cover handle 12 of the paper feeding cover 11 when the cover member 14 is in the closed position.

When the cover member 14 is in the open position as shown in FIG. 6, the cover member 14 serves as an extension tray of the tray main body 5. Accordingly, when an original 6 larger than a sheet mount surface of the tray main body 5 is fed, the cover member 14 can prevent the original 6 from hanging down, and therefore can prevent such a problem that the original 6 is damaged.

Both ends of the connecting part 14*f* are rotatably supported by both ends of a back end portion of the tray main body 5 in a sheet feeding direction, thereby the cover member 14 can freely move rotationally between the closed position shown in FIG. 5 where the cover member 14 is folded to be retracted in the tray main body 5 and the open position shown in FIG. 6. In the connection between the cover member 14 and the tray main body 5, any methods, such as a configuration in which convex portions formed on both sides of the back end portion of the tray main body 5 in the sheet feeding direction are rotatably fitted into concave portions formed on both ends of the connecting part 14*f* of the cover member 14 and a configuration using a connecting shaft, can be used. Furthermore, the connecting part 14*f* of the cover member 14 is formed into a shaft-like shape, and the rigidity of the connecting part 14*f* can be increased as compared with a connecting part such as a hinge. Therefore, when the cover member 14 is used in the open position, even if an amount of sheets mounted on the cover member 14 is large, the connecting part 14*f* can sufficiently bear the weight of the sheets and is unlikely to be damaged.

Moreover, as described above, the cover member 14 according to the present embodiment is formed with the opening 14*g* for sheet insertion which penetrates through from the upper surface to the bottom surface of the cover member 14 so that originals 6 can be inserted into the tray main body 5 when the cover member 14 is in the closed position. When originals 6 are inserted into this opening 14*g* and set in the tray main body 5, the number of originals 6 can be inserted and set in the tray main body 5 depends on a gap between the bottom surface of the edge of the opening 14*g* in the sheet feeding direction and the mount surface 14*i* which is the top surface of the tray main body 5. To enable about the same number of originals as a conventional paper feeding tray to be inserted and set in the paper feeding tray 500 according to the present embodiment, the gap only has to be about the same as that of a conventional sheet insertion slot, and there are no restrictions on the distance between the end of the tray main body 5 and the cover member 14 in the connecting part. Therefore, it enables a configuration in which the cover member 14 and the tray main body 5 are connected by bringing the side end of the cover member 14 close to the end of the tray main body 5, thereby increasing the rigidity of the connecting part.

Figure 7:
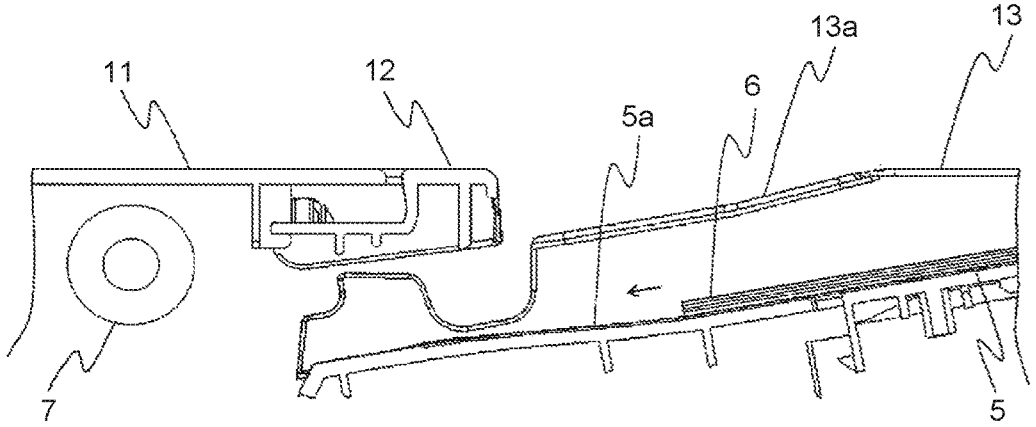
FIG. 7 is a cross-sectional view of the vicinity of a pick-up roller when the cover member of the automatic document feeder according to the present embodiment has moved rotationally to the open position.

FIG. 7 is a cross-sectional view of the vicinity of the pick-up roller 7 when the cover member 14 of the ADF 1 according to the present embodiment has moved rotationally to the open position. When the cover member 14 is in the open position as shown in FIG. 7, the upper guide parts 13*a* of a pair of the side fences 13 guide the conveyance of originals 6 to the pick-up roller 7 while controlling the position of the top surface of the originals 6 in an upper direction.

Figure 8:
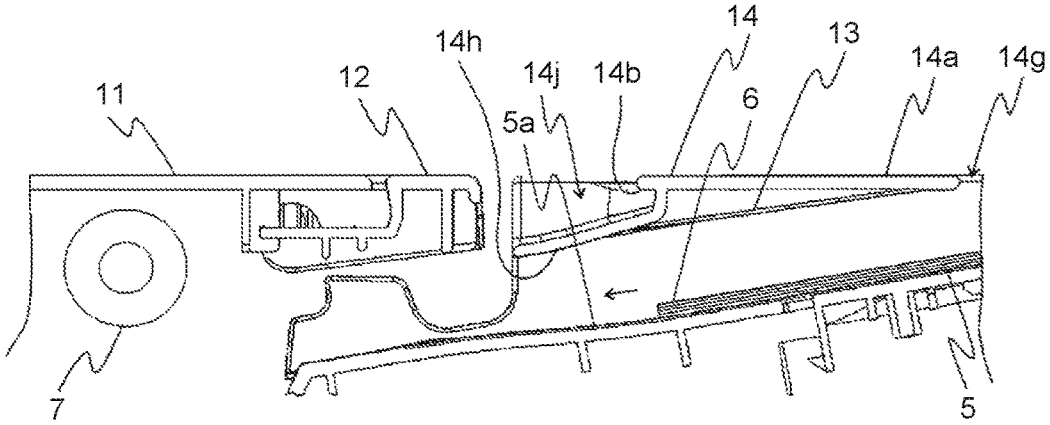
FIG. 8 is a cross-sectional view of the vicinity of the pick-up roller when the cover member of the automatic document feeder according to the present embodiment has moved rotationally to the closed position.

FIG. 8 is a cross-sectional view of the vicinity of the pick-up roller 7 when the cover member 14 of the ADF 1 according to the present embodiment has moved rotationally to the closed position. As shown in FIG. 8, a handle concave portion 14*j* is formed on the handle 14*b* of the cover member 14 so that a user can insert his/her fingers into the handle concave portion 14*j* to open/close the cover member 14. The bottom surface of this handle concave portion 14*j* is a handle inclined surface 14*h* which is inclined toward the pick-up roller 7. The handle concave portion 14*j* and the handle inclined surface 14*h* are provided in the center of the cover member 14 in the direction perpendicular to the direction of conveying originals 6 as with the pick-up roller 7. Accordingly, when the cover member 14 is in the closed position, the handle inclined surface 14*h* guides the conveyance of the originals 6 to the pick-up roller 7 while controlling the position of the top surface of the originals 6 in the upper direction in cooperation with the upper guide parts 13*a* of a pair of the side fences 13. Therefore, it is possible to reduce the cost as compared with a configuration in which a member for guiding originals 6 to the pick-up roller 7 is provided separately.

Furthermore, as described above, the handle 14*b* of the cover member 14 is provided in the position opposed to the paper-feeding-cover handle 12 of the paper feeding cover 11 when the cover member 14 is in the closed position. Therefore, a user can insert his/her fingers into the handle concave portion 14*j* of the cover member 14 to operate the paper-feeding-cover handle 12 of the paper feeding cover 11. Accordingly, the handle concave portion 14*j* can be used in both the operation to open the cover member 14 and the operation to open the paper feeding cover 11, thereby the space conservation and cost reduction of the device can be achieved.

Figure 9:
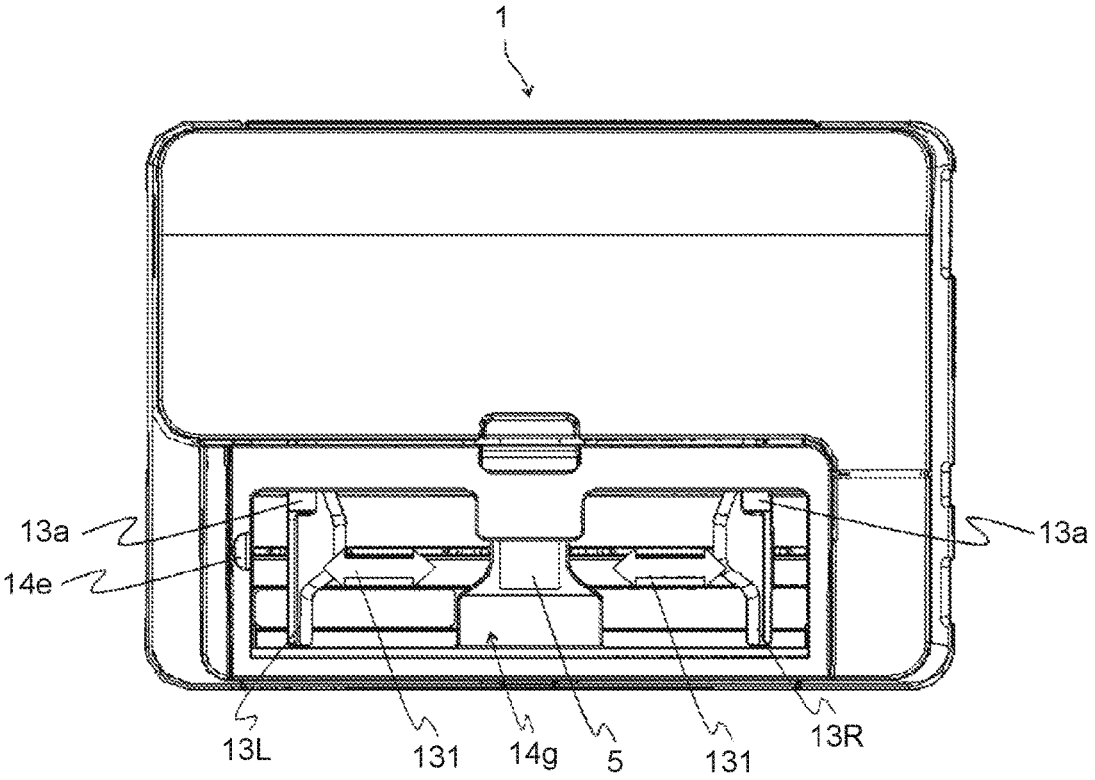
FIG. 9 is a top view of the automatic document feeder according to the present embodiment when the cover member has moved rotationally to the closed position.

FIG. 9 is a top view of the ADF 1 according to the present embodiment when the cover member 14 has moved rotationally to the closed position, and is a diagram showing the moving range of a pair of the side fences 13. As shown in FIG. 9, the opening 14*g* of the cover member 14 is formed so that the upper guide parts 13*a* of a pair of the side fences 13 are always exposed within the moving range of a pair of the side fences 13. A pair of the side fences 13 is composed of a pair of a left side fence 13L and a right side fence 13R that move in conjunction in the opposite direction to each other and in the direction perpendicular to the sheet conveying direction within a range indicated by an arrow 131 showing a movable range. When originals 6 are set in the tray main body 5, the left side fence 13L and the right side fence 13R are moved according to the sheet width of the originals 6 in the direction perpendicular to the sheet conveying direction to set the originals 6 in the center position of the tray main body 5.

If the left side fence 13L and the right side fence 13R which compose a pair of the side fences 13 are moved in a direction in which the distance between them is increased, the left side fence 13L and the right side fence 13R can be moved to a contact position with the cover member 14. However, if the left side fence 13L and the right side fence 13R have been moved to the contact position with the cover member 14, the operability may become worse because it is difficult to hold the both fences when they are moved to a direction in which the distance between them is reduced. Therefore, as shown in FIG. 9, a concave portion 14*e* for side-fence operation is provided on the left side of the cover member 14 in contact with which the upper guide part 13*a* of the left side fence 13L. Accordingly, a user can insert his/her fingers into the concave portion 14*e* for side-fence operation to operate the upper guide part 13*a* of the left side fence 13L, and the operability is improved especially when the left side fence 13L and the right side fence 13R are moved to the direction in which the distance between them is reduced. Incidentally, in an example shown in FIG. 9, the concave portion 14*e* for side-fence operation is provided on the left side of the cover member 14; however, the present invention is not limited to this configuration, and the concave portion 14*e* for side-fence operation can be provided on the right side of the cover member 14 in contact with which the upper guide part 13*a* of the right side fence 13R, or the concave portions 14*e* for side-fence operation can be provided on both the left and right sides of the cover member 14.

Figure 10:
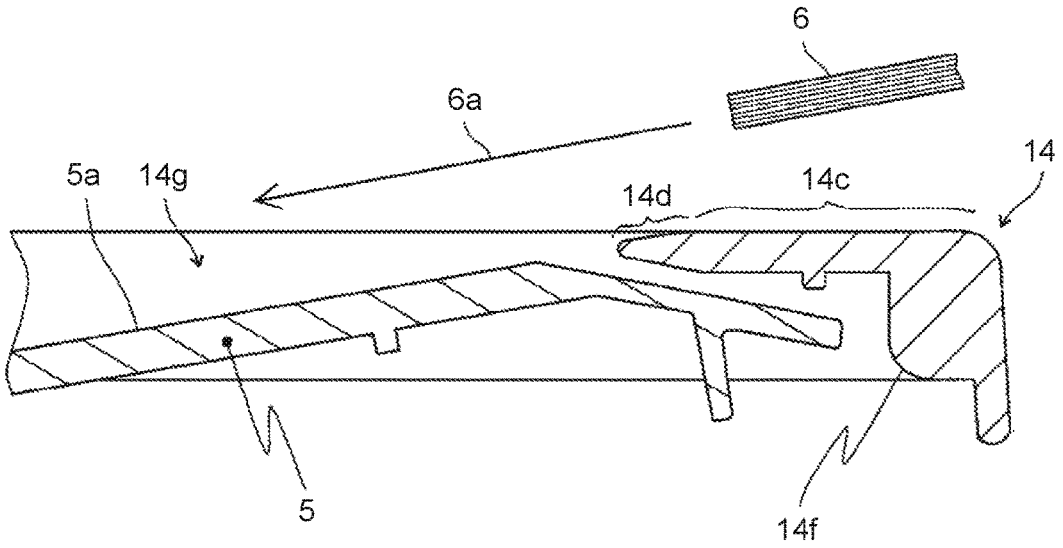
FIG. 10 is an enlarged cross-sectional view of a portion near a connecting part when the cover member of the automatic document feeder according to the present embodiment has moved rotationally to the closed position.

FIG. 10 is an enlarged cross-sectional view of a portion near the connecting part 14*f* when the cover member 14 of the ADF 1 according to the present embodiment has moved rotationally to the closed position.

As shown in FIG. 10, the cover member 14 has a flat portion 14*c* as a third mount surface that serves as an exterior surface when the cover member 14 is in the closed position, and also is formed so as to extend in the direction perpendicular to the direction of conveying originals 6 to be able to support the originals 6. Furthermore, in the cover member 14, an inclined surface 14*d*, which is inclined gradually toward a direction of inserting originals 6 so as to be closer to the mount surface 5*a* of the tray main body 5, is formed on the end of the flat portion 14*c* on the side of the opening 14*g*. More specifically, the inclined surface 14*d* of the cover member 14 is formed along a virtual surface that an inclined surface on the mount surface 5*a* of the tray main body 5 is extended. Furthermore, the flat portion 14*c* of the cover member 14 is provided on the upstream side of the inclined surface 14*d* in the direction of inserting originals 6. Incidentally, an arrow 6*a* in FIG. 10 indicates a direction of setting the originals 6 in the tray main body 5 and a direction of conveying the set originals 6.

In FIG. 10, when the originals 6 are mounted on over the mount surface 5*a* of the tray main body 5 and the flat portion 14*c* of the cover member 14, the weight of the originals 6, which would be concentrated on a portion in line contact with the edge of the cover member 14 if the inclined surface 14*d* were not formed, is dispersed on the inclined surface 14*d*. Accordingly, it is possible to prevent such a problem that originals 6 are damaged due to the occurrence of creases or wrinkles on the originals 6 when the originals 6 are set or the occurrence of scratches on the originals 6 when the originals 6 are conveyed. Furthermore, the flat portion 14*c* which serves as an exterior surface can support the originals 6 and prevent the original 6 from hanging down.

Comparative Example

Figure 11:
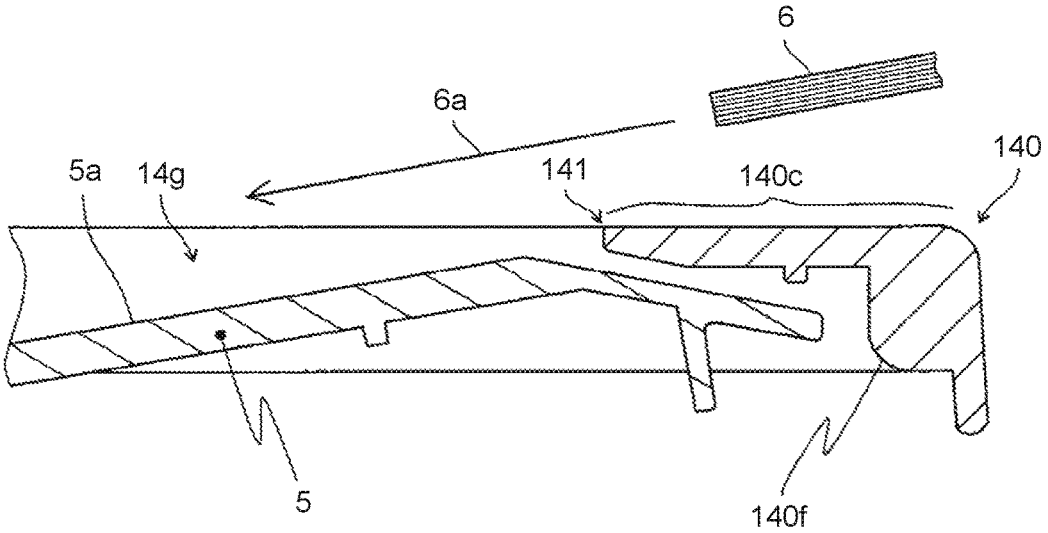
FIG. 11 is an enlarged cross-sectional view of a portion near a connecting part when a cover member of an automatic document feeder according to a comparative example has moved rotationally to the closed position.

FIG. 11 is an enlarged cross-sectional view of a portion near a connecting part 140*f* when a cover member 140 according to a comparative example is in the closed position.

As shown in FIG. 11, the cover member 140 according to the comparative example has a flat portion 140*c* which serves as an exterior surface when the cover member 140 is in the closed position. However, there is no inclined surface as illustrated in FIG. 10 formed, and an end of the flat portion 140*c* on the side of the mount surface 5*a* of the tray main body 5 is a roughly right-angled edge 141 instead. If there is the edge 141 of the cover member 140 near the mount surface 5*a* of the tray main body 5 in this way, originals 6 may be damaged due to the occurrence of creases or wrinkles on the originals 6 when the originals 6 are set or the occurrence of scratches on the originals 6 when the originals 6 are conveyed. Incidentally, also in the cover member 140 according to the present comparative example, the flat portion 140*c* which serves as an exterior surface can support the originals 6 and prevent the original 6 from hanging down.

Modification 1

Figure 12A:
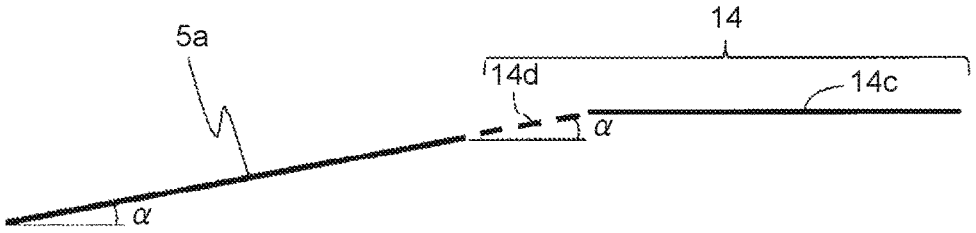
FIGS. 12A and 12B are schematic diagrams for explaining the inclination angle of an inclined surface of a cover member according to Modification 1.
Figure 12B:
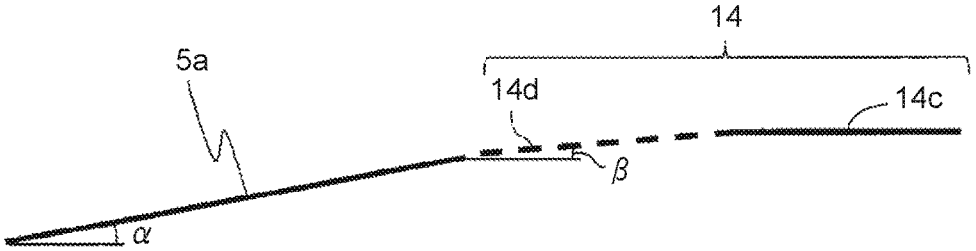

FIGS. 12A and 12B are schematic diagrams for explaining the inclination angle of the inclined surface 14*d* of the cover member 14 according to Modification 1; FIG. 12A is a schematic diagram for the inclination angle of the inclined surface according to the above-described embodiment, and FIG. 12B is a schematic diagram for the inclination angle of the inclined surface according to Modification 1. Incidentally, inclination angles α and β in FIG. 12 are each an inclination angle to a horizontal plane.

In FIG. 12A, as explained in the above-described embodiment, the inclined surface 14*d* of the cover member 14 is what the mount surface 5*a* of the tray main body 5 is extended; therefore, the inclination angle of the inclined surface 14*d* is equal to the inclination angle of the mount surface 5*a*.

On the other hand, as shown in FIG. 12B), it is formed so that the inclination angle β of the inclined surface 14*d* of the cover member 14 according to the present Modification 1 is smaller than the inclination angle α of the mount surface 5*a* of the tray main body 5. Accordingly, bent portions are formed at the following two places: the boundary between the flat portion 14*c* of the cover member 14 and the inclined surface 14*d* and the boundary between the inclined surface 14*d* of the cover member 14 and the mount surface 5*a* of the tray main body 5, respectively. When originals 6 are mounted over the mount surface 5*a* of the tray main body 5 and the flat portion 14*c* of the cover member 14, the originals 6 are bent at the two places, so the bending angle can be reduced closer to a more obtuse angle as compared with a case of one bent portion. Therefore, the creases or wrinkles on the originals 6 when the originals 6 are set and the scratches on the originals 6 when the originals 6 are conveyed are less likely to occur, so it is possible to prevent the originals 6 from being damaged more surely.

Modification 2

Figure 13:
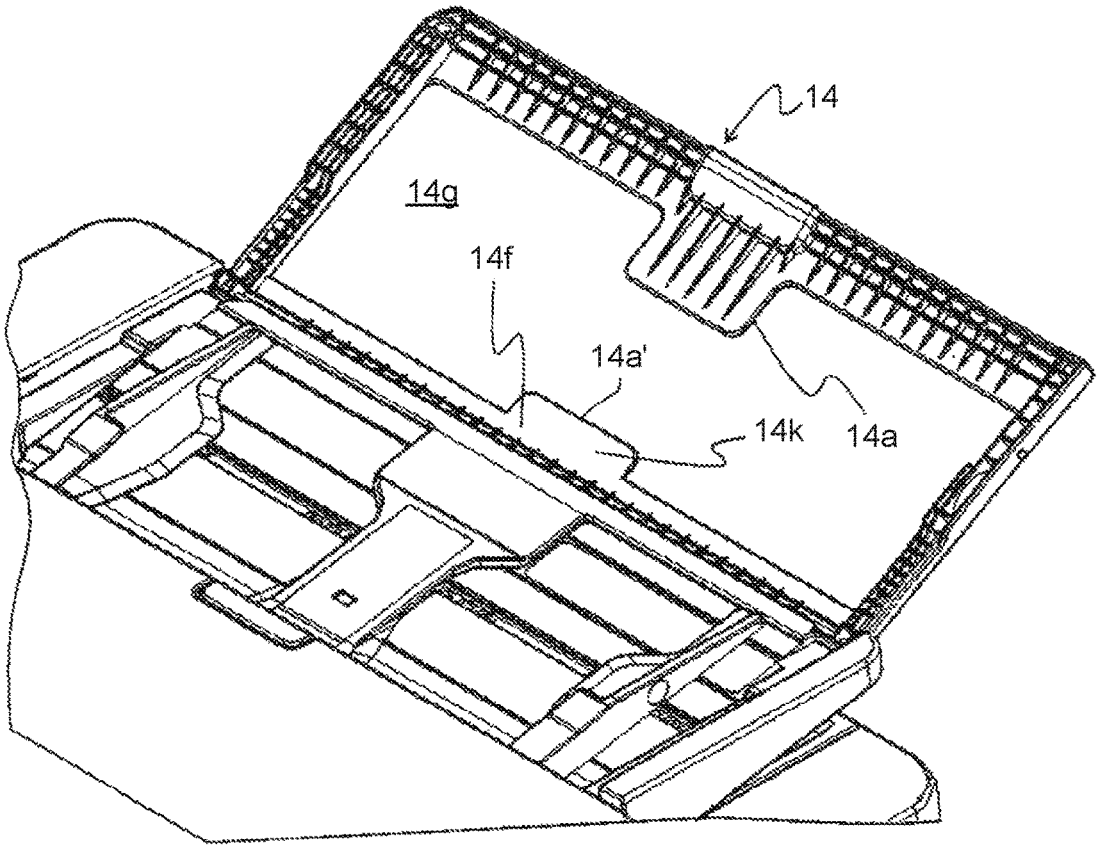
FIG. 13 is a perspective view of a cover member according to Modification 2 when the cover member is in the open position.

FIG. 13 is a perspective view of the cover member 14 according to Modification 2 when the cover member 14 is in the open position. As shown in FIG. 13, the cover member 14 according to the present Modification 2 is provided with a second projecting portion 14*a*' projecting toward the opening 14*g* as a projecting portion of the connecting part 14*f* in addition to the above-described first projecting portion 14*a*. Furthermore, the second projecting portion 14*a*' is formed with a flat portion 14*k* as a fourth mount surface that supports part of the underside of originals 6 when the cover member 14 is in the open position. This flat portion 14*k* is provided so as to further extend in the width direction perpendicular to the direction of inserting the originals 6 at the end of the cover member 14 on the side of the opening 14*g*. By providing the second projecting portion 14*a*' serving as a mount surface of originals 6 on the side of the opening 14*g* when the cover member 14 is in the open position, the original 6 can be prevented from hanging down from the opening 14*g* and can be held in an intended position. Furthermore, the flat portion 14*k* supports part of the underside of the originals 6, thereby it is possible to prevent creases or scratches on the original 6.

Incidentally, in FIG. 13, there is described a configuration in which there are several projecting portion, i.e., the first projecting portion 14*a* and the second projecting portion 14*a*'; however, it can be configured that only the second projecting portion 14*a*' is provided without providing the first projecting portion 14*a*.

Subsequently, there is described an example of an image forming apparatus 100 including the ADF 1 according to the present embodiment. Incidentally, in the present embodiment, there is described a case where the image forming apparatus is an electrophotographic copier; however, the present invention can be applied to any type of image forming apparatus other than an electrophotographic copier as long as the image forming apparatus includes a sheet feeding device.

First, a basic configuration of the image forming apparatus 100 according to the present embodiment is explained.

Figure 14:
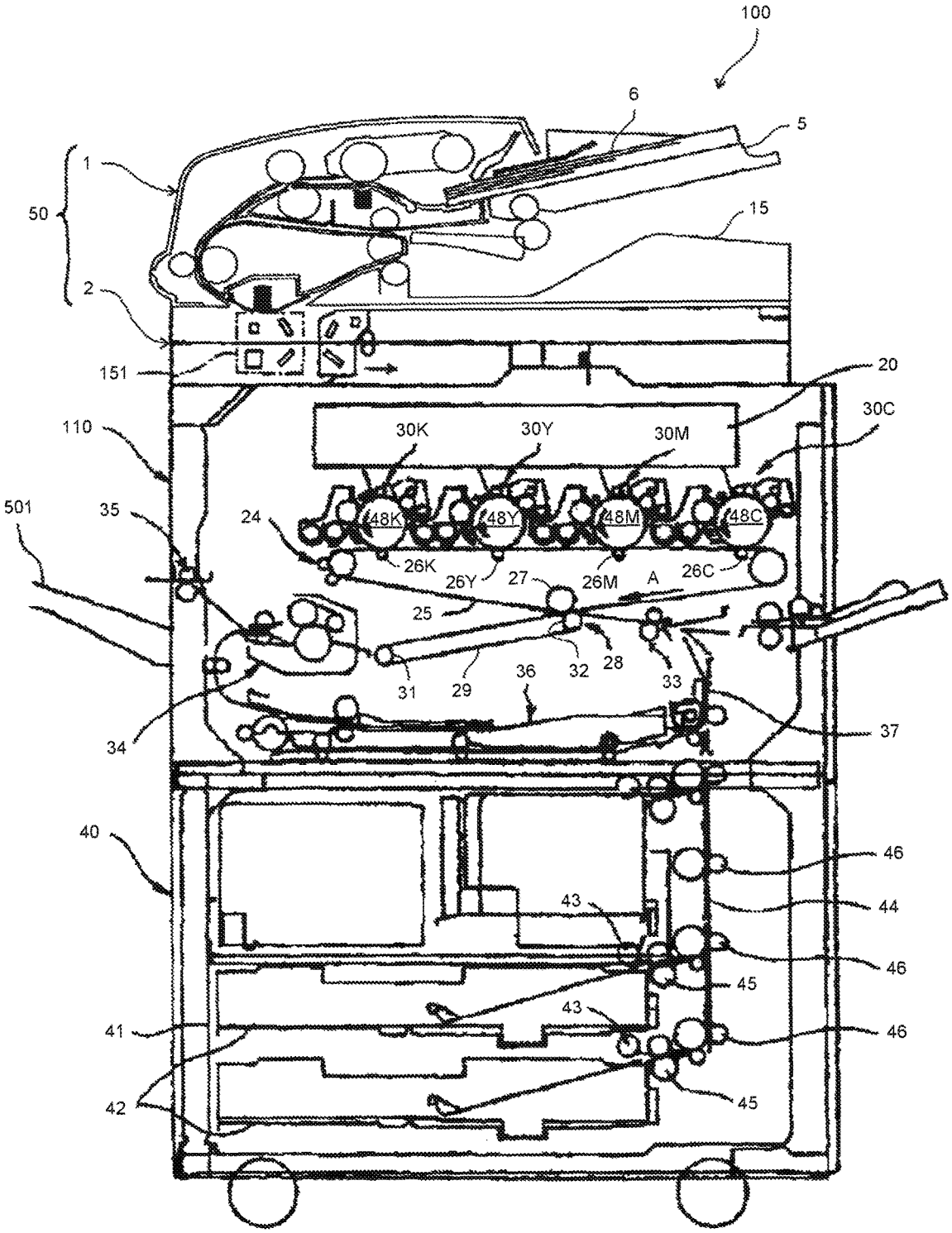
FIG. 14 is a schematic configuration diagram showing an example of an image forming apparatus including the automatic document feeder according to the embodiment.

FIG. 14 is a schematic configuration diagram showing an example of the basic configuration of the image forming apparatus 100. The image forming apparatus 100 includes an image forming unit 110 as an image forming means, a transfer-sheet feeding device 40, and an image reading unit 50. The image reading unit 50 includes the image reading device 2 fixed on the image forming unit 110 and the ADF 1, which is an original feeding means as a sheet feeding device supported by the image reading device 2.

The transfer-sheet feeding device 40 includes two transfer-sheet feeding cassettes 42 arranged in multi-tiered levels in a paper bank 41. The transfer-sheet feeding device 40 further includes transfer-sheet delivery rollers 43 that deliver a transfer sheet from the respective transfer-sheet feeding cassettes 42, transfer-sheet separation rollers 45 that separate delivered transfer sheets and feed the separated transfer sheet one by one into a transfer-sheet feeding path 44, etc. The image forming apparatus 100 further includes a main-body-side transfer-sheet feeding path 37 as a transfer-sheet feeding path of the image forming unit 110, a plurality of conveyance rollers 46 that convey a transfer sheet as a recording medium, etc. A transfer sheet contained in the transfer-sheet feeding cassette 42 is fed into the main-body-side transfer-sheet feeding path 37 in the image forming unit 110.

The image forming unit 110 includes an optical writing device 20 and four process units 30 (30K, 30Y, 30M, and 30C) that form black (K), yellow (Y), magenta (M), and cyan (C) toner images, respectively. The image forming unit 110 further includes a transfer unit 24, a sheet conveying unit 28, a pair of registration rollers 33, a fixing device 34, a transfer-sheet reversing device 36, the main-body-side transfer-sheet feeding path 37, etc. The optical writing device 20 drives light sources such as laser diodes or LEDs arranged inside thereof to irradiate four drum-like photoconductors 48 (48K, 48Y, 48M, and 48C) as image bearers with laser light L. Through this irradiation, electrostatic latent images are formed on the surfaces of the photoconductors 48 (48K, 48Y, 48M, and 48C), respectively. Then, the electrostatic latent images are developed into toner images, respectively, through a predetermined developing process.

The process units 30 (30K, 30Y, 30M, and 30C) each support a corresponding photoconductor 48 and various devices arranged around the photoconductor 48 as one unit with a common support, and are removably attached to the image forming unit 110 in the image forming apparatus main body. Each process unit 30 includes a charging device, a developing device, a drum cleaning device, a static eliminating lamp, etc. around the photoconductor 48. The image forming apparatus 100 has a so-called tandem-type configuration in which the four process units 30 (30K, 30Y, 30M, and 30C) are arranged to be opposed to an intermediate transfer belt 25 along an endless moving direction of the intermediate transfer belt 25.

Through the developing process, K, Y, M, and C-toner images are formed on the photoconductors 48 (48K, 48Y, 48M, and 48C) of the four process units 30 (30K, 30Y, 30M, and 30C), respectively.

The transfer unit 24 is arranged below the four process units 30 (30K, 30Y, 30M, and 30C). The transfer unit 24 forms K, Y, M, and C primary transfer nips by bringing the intermediate transfer belt 25 tensioned by a plurality of rollers into contact with the photoconductors 48 (48K, 48Y, 48M, and 48C). One of the rollers which tension the intermediate transfer belt 25 is driven to rotate as a drive roller, thereby the intermediate transfer belt 25 moves endlessly in a direction of an arrow A in FIG. 14 (a clockwise direction).

Near the respective primary transfer nips, the intermediate transfer belt 25 is pressed against the photoconductors 48 (48K, 48Y, 48M, and 48C) by primary transfer rollers 26 (26K, 26Y, 26M, and 26C) arranged on the inner side of the belt loop. A primary transfer bias is applied to each primary transfer roller 26 (26K, 26Y, 26M, 26C) by an electric power source. Accordingly, primary transfer electric fields for electrostatically moving the toner images on the photoconductors 48 (48K, 48Y, 48M, and 48C) toward the intermediate transfer belt 25 are formed at the K, Y, M, and C primary transfer nips, respectively.

In accordance with the endless movement in the direction of the arrow A in FIG. 14 (the clockwise direction), the intermediate transfer belt 25 sequentially passes through the K, Y, M, and C primary transfer nips, and the toner images are sequentially primary-transferred onto the front surface of the intermediate transfer belt 25 in a manner superimposed on top of another at the primary transfer nips, respectively. Through the primary transfer of the toner images in a manner superimposed on top of another, a four-color superimposed toner image (hereinafter, referred to as a four-color toner image) is formed on the front surface of the intermediate transfer belt 25.

Below the transfer unit 24 in FIG. 14, a sheet conveying unit 28 is provided; the sheet conveying unit 28 causes an endless sheet conveyance belt 29 suspended between a c-belt drive roller 31 and a secondary transfer roller 32 to move endlessly. As shown in FIG. 14, the intermediate transfer belt 25 and the sheet conveyance belt 29 are put between a lower tension roller 27, one of the rollers which tension the intermediate transfer belt 25, and the secondary transfer roller 32. Accordingly, a secondary transfer nip where the front surface of the intermediate transfer belt 25 and the front surface of the sheet conveyance belt 29 come in contact is formed. A secondary transfer bias is applied to the secondary transfer roller 32 by an electric power source, and the lower tension roller 27 is grounded. Accordingly, a secondary transfer electric field is formed at the secondary transfer nip.

On the right-hand side of the secondary transfer nip in FIG. 14, a pair of the registration rollers 33 is arranged. Furthermore, near the entrance of a registration nip formed between a pair of the registration rollers 33, a registration-roller sensor is arranged. After the elapse of a predetermined time since the registration-roller sensor has detected a leading end of a transfer sheet conveyed from the transfer-sheet feeding device 40 toward a pair of the registration rollers 33, the conveyance of the transfer sheet is stopped temporarily, and the leading end of the transfer sheet is struck against the registration nip between a pair of the registration rollers 33. As a result, the posture of the transfer sheet is adjusted, and the transfer sheet gets prepared to synchronize with the image formation.

When the leading end of the transfer sheet has been struck against the registration nip, a pair of the registration rollers 33 resume the rotation to deliver the transfer sheet to the secondary transfer nip. At the secondary transfer nip through which the transfer sheet passes, the four-color toner image on the intermediate transfer belt 25 is collectively secondary-transferred onto the transfer sheet by the effects of the secondary transfer electric field and the nip pressure, and becomes a full-color image by being combined with white color of the transfer sheet. The transfer sheet having passed through the secondary transfer nip comes off from the intermediate transfer belt 25 and put on the front surface of the sheet conveyance belt 29, and conveyed to the fixing device 34 in accordance with the endless movement of the sheet conveyance belt 29.

Transfer residual toner, which has not been transferred to the transfer sheet at the secondary transfer nip, remains on the front surface of the intermediate transfer belt 25 having passed through the secondary transfer nip. This transfer residual toner is scraped and removed by a belt cleaning device of which the cleaning member is in contact with the intermediate transfer belt 25.

The full-color image is fixed on the transfer sheet conveyed to the fixing device 34 by application of pressure and heat in the fixing device 34. The transfer sheet with the full-color image fixed thereon is conveyed from the fixing device 34 to a pair of paper ejection rollers 35, and then is ejected onto a paper ejection tray 501 located outside the apparatus.

As shown in FIG. 14, below the sheet conveying unit 28 and the fixing device 34, the transfer-sheet reversing device 36 is arranged.

When duplex printing is performed, the conveyance path of a transfer sheet after completion of an image fixing process on one side of the transfer sheet is switched to the side of the transfer-sheet reversing device 36 by a switching claw, and the transfer sheet is reversed there and again enters the secondary transfer nip. Then, after a secondary transfer process and a fixing process have been performed on the other side of the transfer sheet, the transfer sheet is ejected onto the paper ejection tray 501.

When the image forming apparatus 100 configured as described above makes a copy of a bundle of originals 6, after the originals 6 have been set in the tray main body 5 of the ADF 1, a COPY START button on the operation unit is pressed. Then, the ADF 1 sequentially feeds the bundle of originals 6 mounted on the tray main body 5 into an original conveyance path in order from the top sheet of the bundle, and conveys each original 6 toward an original stack table 15 while reversing the original 6. In the course of this conveyance, immediately after the original 6 has been reversed, the ADF 1 causes the original 6 to pass through just above a stationary reading unit 151 of the image reading device 2. At this time, an image of the original 6 is read by the stationary reading unit 151 of the image reading device 2. The image read by the stationary reading unit 151 is sent to the image forming unit 110, and a copy of the image is formed on a transfer sheet through the above-described image forming process.

Incidentally, in the above embodiment, there is described the case where the sheet feeding device of the image forming apparatus (a copier) is the ADF 1; however, the present invention can also be applied to a paper feeding device as a sheet feeding device that feeds sheets of paper on which an image is to be formed by an image forming apparatus. Furthermore, the present invention dose not limit the type of sheets to originals or sheets of paper on which an image is to be formed by an image forming apparatus, and can also be applied to sheet feeding devices that feed any other types of sheets.

The above description is just an example, and the present invention achieves effects specific to each of the following Aspects.

Aspect A

A sheet feeding device such as the ADF 1 includes a tray main body 5 and a cover member 14. The tray main body 5 has a first mount surface such as the mount surface 5*a* on which a sheet such as an original 6 to be fed is mounted so that the sheet can be fed from the end thereof. The cover member 14 is rotatably connected to an end of the tray main body 5 on the side opposite to the sheet feeding side so that the cover member 14 can move rotationally between a closed position where the cover member 14 covers the first mount surface of the tray main body 5 and an open position where the first mount surface of the tray main body 5 is exposed, and has a second mount surface such as a mount surface 14*i* on which a sheet to be fed is mounted over the first mount surface of the tray main body 5 when cover member 14 is in the open position. The cover member 14 includes an opening 14*g* which penetrates through from an upper surface to a bottom surface of the cover member so that a sheet can be inserted onto the first mount surface of the tray main body 5 when the cover member 14 is in the closed position.

According to this, as explained in the above embodiment, the cover member 14 has the opening 14*g* for sheet insertion which penetrates through from the upper surface to the bottom surface thereof; therefore, independently of the opening for sheet insertion, the side end of the cover member is brought close to the end of the tray main body on the side opposite to the sheet feeding direction and connecting the two, thereby the rigidity of the connecting part between the two can be increased. Therefore, the connecting part between the cover member and the tray main body is less likely to be damaged when the cover member is moved rotationally to the open position and a sheet is mounted on over the mount surface of the tray main body and the upper surface of the cover member.

Aspect B

In the above Aspect A, the cover member 14 has a second mount surface such as the mount surface 14*i* in an exposed part thereof on the side opposite to the end connected to the tray main body 5 across the opening 14*g* when the cover member 14 is in the open position.

According to this, as explained in the above embodiment, when the cover member 14 is in the open position, the second mount surface of the cover member 14 is located in a position away from the first mount surface; therefore, the cover member 14 can support even a long-size sheet without causing such a situation that the trailing end side of the sheet in the inserting direction hangs down.

Aspect C

In the above Aspect A or B, the cover member 14 has a third mount surface such as the flat portion 14*c* that supports part of the underside of a sheet inserted through the opening 14*g* in an exposed part thereof between the end connected to the tray main body 5 and the opening 14*g* when the cover member 14 is in the closed position.

According to this, as explained in the above embodiment, when the cover member 14 is in the closed position, part of the underside of a sheet inserted through the opening 14*g* is supported by the third mount surface; therefore, a sheet can be fed and conveyed smoothly while preventing the trailing end side of the sheet in the feeding direction from hanging down.

Aspect D

In the above Aspect C, the cover member 14 has the inclined surface 14*d* that is inclined gradually toward the sheet inserting direction so as to be closer to the first mount surface of the tray main body 5 on the end of the third mount surface on the side of the opening 14*g*.

According to this, as explained in the above embodiment, part of the underside of a sheet is in surface contact with the inclined surface, and the weight of the sheet is dispersed on the inclined surface as compared with a case of line contact with the edge. Therefore, it is possible to prevent the sheet from being damaged because the occurrence of creases or wrinkles on the sheet when the sheet is set or the occurrence of scratches on the sheet when the sheet is fed and conveyed is suppressed.

Aspect E

In the above Aspect D, at least an end of the first mount surface of the tray main body 5 on the side opposite to the sheet feeding direction has an inclined surface that is inclined downward gradually toward the sheet feeding direction, and the inclined surface 14*d* of the cover member 14 is formed along a virtual surface that the inclined surface on the first mount surface of the tray main body 5 is extended.

According to this, as explained in the above embodiment, a sheet is mounted on the continuous inclined surfaces, which are the inclined surface on the first mount surface of the tray main body 5 and the inclined surface 14*d* of the cover member 14. Therefore, the occurrence of creases or wrinkles on the sheet when the sheet is set or the occurrence of scratches on the sheet when the sheet is fed and conveyed is suppressed further.

Aspect F

In the above Aspect D, at least an end of the first mount surface of the tray main body 5 on the side opposite to the sheet feeding direction has an inclined surface that is inclined downward gradually toward the sheet feeding direction, and an inclination angle of the inclined surface 14*d* of the cover member 14 is smaller than that of the inclined surface on the first mount surface of the tray main body 5.

According to this, as explained in Modification 1 of the above embodiment, an inclination angle between the inclined surface on the first mount surface of the tray main body 5 and the inclined surface 14*d* of the cover member 14 becomes closer to a horizontal angle; therefore, the sheet is supported by the inclined surface 14*d* of the cover member 1 at a more obtuse angle, and the sheet is further suppressed from being creased.

Aspect G

In any of the above Aspects A to F, the cover member 14 is provided with a projecting portion such as the second projecting portion 14*a*' that projects toward the side of the opening 14*g* in the center of the cover member 14 in the width direction perpendicular to the sheet inserting direction, and the projecting portion has a fourth mount surface such as the flat portion 14*k* that supports the sheet when the cover member 14 is in the open position.

According to this, as explained in the above embodiment, it is possible to achieve the space conservation of the device, and also the fourth mount surface of the projecting portion when the cover member 14 is in the open position makes it possible to suppress the trailing end side of the sheet in the feeding/conveying direction from hanging down from the opening 14*g*.

Aspect H

In any of the above Aspects C to G, at least either the third mount surface or the fourth mount surface of the cover member 14 has a flat portion such as the flat portion 14*c* or the flat portion 14*k* that supports part of the underside of the sheet inserted through the opening 14*g*.

According to this, as explained in the above embodiment or Modification 2, the sheet is supported by the third mount surface such as the flat portion 14*c* or the fourth mount surface such as the flat portion 14*k* when the cover member 14 is in the open position; therefore, it is possible to prevent the sheet from being damaged.

Aspect I

In the above Aspect H, the flat portion 14*c* or the flat portion 14*k* of at least either the third mount surface or the fourth mount surface of the cover member 14 extends in the width direction perpendicular to the sheet inserting direction.

According to this, as explained in the above embodiment or Modification 2, because of the width direction perpendicular to the sheet inserting direction, the sheet can be prevented from being damaged.

Aspect J

The image forming apparatus 100 includes an original feeding unit such as the ADF 1 that feeds an original 6; an image reading unit such as the image reading device 2 that reads an image of the original 6 fed by the original feeding unit; and an image forming unit such as the image forming unit 110 that forms an image on a recording medium such as a transfer sheet on the basis of image data of the image read by the image reading unit. The image forming apparatus 100 includes the sheet feeding device according to any of the above Aspects A to I as the original feeding unit.

According to this, as explained in the above embodiment, damage on the connecting part between the cover member 14 which is the original feeding unit and the tray main body 5 can be prevented by increasing the rigidity of the connecting part; therefore, the reliability of the original feeding unit can be enhanced.

Aspect K

A sheet feeding device such as the ADF 1 includes the tray main body 5 that has a first mount surface such as the mount surface 5*a* on which a sheet such as an original 6 to be fed in a predetermined direction is mounted; the cover member 14 that is rotatably connected to an end of the tray main body on the side opposite to the sheet feeding side so that the cover member 14 can move rotationally between a closed position where the cover member 14 covers the first mount surface of the tray main body 5 and an open position where the first mount surface of the tray main body 5 is exposed, and has a second mount surface such as the mount surface 14*i* on which a sheet to be fed is mounted over the first mount surface of the tray main body 5 when cover member 14 is in the open position; the opening 14*g* for sheet insertion through which a sheet can be inserted onto the first mount surface of the tray main body 5 when the cover member 14 is in the closed position; and a pair of side fences that controls movement of a sheet mounted on the first mount surface of the tray main body in a width direction perpendicular to a sheet feeding direction. The cover member 14 is formed so that at least part of both a pair of the side fences 13 are exposed when the cover member 14 is in the closed position.

According to this, as explained in the above embodiment, at least part of both a pair of the side fences 13 are exposed when the cover member 14 is in the closed position; therefore, the position of the side fences 13 can be recognized. Therefore, when a sheet is inserted through the opening 14*g* for sheet insertion and set in the tray main body 5 when the cover member 14 is in the closed position, the sheet can be certainly set in the predetermined position between a pair of the side fences 13. Accordingly, it is possible to prevent such a sheet setting failure that a leading end of a sheet enters between the upper ends of the side fences 13 and the cover member 14 when the sheet is inserted through the opening 14*g* for sheet insertion and set in the tray main body 5 in a state where the cover member 14 is closed.

Aspect L

In the above Aspect K, a pair of the side fences 13 each include an upper guide part 13*a* on an upper end thereof; the upper guide parts 13*a* guide a sheet mounted on the first mount surface of the tray main body 5 by pushing both ends of the sheet in the width direction from above. The cover member 14 is formed so that the respective upper guide parts 13*a* of a pair of the side fences 13 are exposed.

According to this, as explained in the above embodiment, when a sheet is inserted/mounted when the cover member 14 is in the closed position, even if the sheet to be fed is bent in the width direction and ends of the sheet in the width direction are curved up, the upper guide parts 13*a* can push the ends of the sheet from above and guide the sheet onto the first mount surface of the tray main body 5. The sheet is mounted on the first mount surface of the tray main body 5 by the upper guide parts 13*a* pushing the ends of the sheet in the width direction from above and guiding the sheet onto the first mount surface of the tray main body 5 in this way, so the ends of the sheet in the width direction are less likely to be creased or caught in any surrounding member when the sheet is being fed from the tray main body 5. Therefore, it is possible to suppress the occurrence of scratches or a paper jam due to the curled-up ends of the sheet in the width direction when the sheet mounted on the tray main body 5 is delivered and fed in a state where the cover member 14 is in the closed position. Furthermore, it is possible to achieve the space conservation and cost reduction of the device as compared with a configuration in which the upper guide parts are provided independently of a pair of the side fences 13.

Aspect M

In the above Aspect K or L, the opening 14*g* for sheet insertion is an opening which penetrates through from the upper surface to the bottom surface of the cover member 14 so that a sheet can be inserted onto the first mount surface of the tray main body 5 when the cover member 14 is in the closed position, and the opening 14*g* is formed so that at least part of both a pair of the side fences 13 are exposed when the cover member 14 is in the closed position.

According to this, as explained in the above embodiment, at least part of both a pair of the side fences 13 are exposed from the opening 14*g* for sheet insertion of the cover member 14 when the cover member 14 is closed; therefore, the position of the side fences 13 can be recognized. Therefore, when a sheet is inserted through the opening 14*g* for sheet insertion of the cover member 14 and set in the tray main body 5 when the cover member 14 is closed, the sheet can be certainly set in the predetermined position between a pair of the side fences 13. Accordingly, it is possible to prevent such a sheet setting failure that a leading end of a sheet enters between the upper ends of the side fences 13 and the cover member 14 when the sheet is inserted through the opening 14*g* for sheet insertion and set in the tray main body 5 in a state where the cover member 14 is closed.

Furthermore, as the cover member 14 has the opening 14*g* for sheet insertion which penetrates through from the upper surface to the bottom surface thereof, there are no restrictions on the distance between the cover member 14 and the tray main body 5 in the connecting part; therefore, it enables a configuration in which the cover member 14 and the tray main body 5 are connected by bringing the side end of the cover member 14 close to the end of the tray main body 5 on the side opposite to the sheet feeding direction, thereby the rigidity of the connecting part between the two can be increased. Therefore, the connecting part between the cover member 14 and the tray main body 5 is less likely to be damaged when the cover member 14 is moved rotationally to the open position and a sheet is mounted on over the first mount surface of the tray main body 5 and the upper surface of the cover member 14.

Aspect N

In the above Aspect M, the cover member 14 has the second mount surface such as the mount surface 14*i* in an exposed part thereof on the side opposite to the end connected to the tray main body 5 across the opening 14*g* when the cover member 14 is in the open position.

According to this, as explained in the above embodiment, when the sheet feeding device is used with the cover member 14 open, i.e., in the open position, the second mount surface of the cover member 14 can support the trailing end side of a sheet in the feeding direction, and therefore can prevent the sheet from hanging down. For example, even in a case of a special-size sheet such as a legal-size sheet, the trailing end side of the special-size sheet in the feeding direction can be supported by the second mount surface, and therefore it is possible to prevent the sheet from hanging down from the opening 14*g*.

Aspect O

In any of the above Aspects K to N, the sheet feeding device further includes a sheet conveying unit and an exterior cover; the sheet conveying unit is composed of the pick-up roller 7, the feed roller 9, the separation pad 10, etc., and conveys a sheet mounted on the tray main body 5 to feed the sheet; the exterior cover such as the paper feeding cover 11 is openably and closably provided so that the exterior cover can be open and closed between a position where the exterior cover covers the sheet conveying unit and a position where the sheet conveying unit is open. A first handle such as the paper-feeding-cover handle 12 used to open and close the exterior cover and a second handle such as the handle 14*b* used to open and close the cover member 14 are provided in positions at which the exterior cover member located in the position where the exterior cover covers the sheet conveying unit and the cover member 14 located in the closed position are opposed to each other, respectively.

According to this, as explained in the above embodiment, the first handle of the exterior cover and the second handle of the cover member can be arranged so as to be located near and opposed to each other. Therefore, the operability of both the exterior cover and the cover member can be improved, and it is possible to achieve the space conservation of the device.

Aspect P

In the above Aspect O, the sheet conveying unit includes a conveying member such as the pick-up roller 7 that is arranged in the center of the sheet conveying unit in the direction perpendicular to the sheet feeding direction and conveys sheets by separating one by one from the sheets. The second handle of the cover member 14 is provided with a concave portion such as the handle concave portion 14*j* in which user's fingers can be inserted, and the bottom surface such as the handle inclined surface 14*h* of the concave portion is inclined toward the side of the sheet conveying unit when the cover member 14 is in the closed position.

According to this, as explained in the above embodiment, the first handle of the exterior cover and the second handle of the cover member can be arranged so as to be located near and opposed to each other. Therefore, the concave portion of the cover member 14 can be used as a space when the first handle of the exterior cover is operated with user's fingers, and it is possible to achieve the space conservation of the device. Furthermore, when the sheet feeding device is used with the cover member 14 closed, i.e., in the closed position, the bottom surface of the concave portion of the cover member 14 serves as a guide that guides a leading end of a sheet to a conveying member, and a guide member for exclusive use does not have to be provided separately; therefore, it is possible to reduce the cost.

(Aspect Q)

In any of the above Aspects K to P, on at least one of portions of the cover member 14 to which a pair of the side fences 13 of the opening 14*g* come closer when the cover member 14 is in the closed position, a concave portion for operation such as the concave portion 14*e* for side-fence operation in which user's fingers can be inserted to operate and move a pair of the side fences 13 is formed.

According to this, as explained in the above embodiment, even when the sheet feeding device is used with the cover member 14 closed, the upper guide parts can be operated by inserting user's fingers into the concave portion for operation, so it is possible to improve the operability when the user moves a pair of the side fences 13.

(Aspect R)

The image forming apparatus 100 includes an original feeding unit such as the ADF 1 that feeds an original 6; an image reading unit such as the image reading device 2 that reads an image of the original 6 fed by the original feeding unit; and an image forming unit such as the image forming unit 110 that forms an image on a recording medium such as a transfer sheet on the basis of image data of the image read by the image reading unit. The image forming apparatus 100 includes the sheet feeding device according to any of the above Aspects K to Q as the original feeding unit.

According to this, as explained in the above embodiment, when an original 6 is inserted through the opening 14*g* for original insertion and set in the tray main body 5 when the cover member 14 is closed, the original 6 can be certainly set in the predetermined position between a pair of the side fences 13. Accordingly, while preventing such an original setting failure that a leading end of an original 6 enters between the upper ends of the side fences 13 and the cover member 14 when the original 6 is inserted through the opening 14*g* for original insertion and set in the tray main body 5 in a state where the cover member 14 is closed, it is possible to form an image on a recording medium.

According to the exemplary embodiments of the present invention, it is possible to suppress the occurrence of damage on a connecting part between a cover member, which can be open and closed according to the size of a sheet to be fed in a sheet feeding direction, and a tray main body when the cover member is rotationally moved to an open position and a sheet is mounted on over a mount surface of the tray main body and an upper surface of the cover member.

Furthermore, according to the exemplary embodiments of the present invention, it is possible to prevent such a sheet setting failure that a leading end of a sheet enters between upper ends of side fences and the cover member when the sheet is inserted through a sheet insertion slot and set in the tray main body in a state where the cover member is closed.

Although the invention has been described with respect to the specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a tray main body, including a first mount surface on which a sheet to be fed in a direction is placeable; and a cover member, rotatably connected to an end of the tray main body on a side opposite to a sheet feeding side such that the cover member is rotationally movable between a closed position, where the cover member covers the first mount surface of the tray main body, and an open position, where the first mount surface of the tray main body is exposed, the cover member including a second mount surface on which a sheet to be fed is placeable over the first mount surface of the tray main body when cover member is in the open position, and an opening for sheet insertion which penetrates through from an upper surface of the cover member to a bottom surface of the cover member such that a sheet is insertable onto the first mount surface of the tray main body when the cover member is in the closed position.

2. The sheet feeding device of claim 1, wherein the cover member includes the second mount surface in an exposed part of the cover member on the side opposite to the end connected to the tray main body across the opening when the cover member is in the open position.

3. The sheet feeding device of claim 2, wherein the cover member includes another mount surface that supports part of the underside of a sheet inserted through the opening in an exposed part of the cover member between the end connected to the tray main body and the opening when the cover member is in the closed position.

4. The sheet feeding device of claim 3, wherein the cover member includes an inclined surface, inclined gradually toward a sheet inserting direction so as to be relatively closer to the first mount surface of the tray main body on an end of the third mount surface on the side of the opening.

5. The sheet feeding device of claim 4, wherein at least an end of the first mount surface of the tray main body on the side opposite to a sheet feeding direction includes an inclined surface, inclined downward gradually toward the sheet feeding direction, and the inclined surface of the cover member is formed along a virtual surface that the inclined surface on the first mount surface of the tray main body is extended.

6. The sheet feeding device of claim 4, wherein at least an end of the first mount surface of the tray main body on the side opposite to a sheet feeding direction includes an inclined surface, inclined downward gradually toward the sheet feeding direction, and an inclination angle of the inclined surface of the cover member is relatively smaller than an inclination angle of the inclined surface on the first mount surface of the tray main body.

7. The sheet feeding device of claim 3, wherein the another mount surface of the cover member includes a flat portion to supports part of the underside of the sheet inserted through the opening.

8. The sheet feeding device of claim 7, wherein the flat portion of the another mount surface of the cover member extends in a width direction perpendicular to a sheet inserting direction.

9. The sheet feeding device of claim 2, wherein the cover member includes a projecting portion to projects toward the opening in the center of the cover member in a width direction, perpendicular to a sheet inserting direction, and the projecting portion includes another mount surface to supports the sheet when the cover member is in the open position.

10. An image forming apparatus comprising:

the sheet feeding device of claim 1, to feed an original;

an image reading unit to read an image of the original fed by the original feeding unit; and an image forming unit to form an image on a recording medium on the basis of image data of the image read by the image reading unit.

11. A sheet feeding device comprising:

a tray main body, including a first mount surface on which a sheet to be fed in a direction is placeable; and a cover member, rotatably connected to an end of the tray main body on a side opposite to the sheet feeding side, such that the cover member is rotationally movable between a closed position, where the cover member covers the first mount surface of the tray main body, and an open position, where the first mount surface of the tray main body is exposed, the cover member including a second mount surface on which a sheet to be fed is placeable over the first mount surface of the tray when cover member is in the open position, an opening being included in the cover member for sheet insertion through which a sheet is insertable onto the first mount surface of the tray main body when the cover member is in the closed position; and a pair of side fences to control movement of a sheet mounted on the first mount surface of the tray main body in a width direction perpendicular to a sheet feeding direction, wherein the cover member is formed so that at least part of both a pair of the side fences are exposed when the cover member is in the closed position.

12. The sheet feeding device of claim 11, wherein the opening for sheet insertion is an opening which penetrates through from an upper surface to a bottom surface of the cover member so that a sheet is insertable onto the first mount surface of the tray main body when the cover member is in the closed position, and wherein the opening is formed so that at least part of both a pair of the side fences are exposed when the cover member is in the closed position.

13. The sheet feeding device of claim 12, wherein a pair of the side fences each include an upper guide part on an upper end thereof, the respective upper guide parts being configured to guide a sheet mounted on the first mount surface of the tray main body by pushing both ends of the sheet in the width direction from above, and wherein the cover member is formed so that the respective upper guide parts of a pair of the side fences are exposed.

14. The sheet feeding device of claim 12, wherein the cover member includes the second mount surface in an exposed part thereof on the side opposite to an end connected to the tray main body across the opening when the cover member is in the open position.

15. The sheet feeding device of claim 11, further comprising:

a sheet conveying unit to convey a sheet on the tray main body to feed the sheet; and an exterior cover, openably and closably provided such that the exterior cover is openable and closable between a position where the exterior cover covers the sheet conveying unit and a position where the sheet conveying unit is open, wherein a first handle, usable to open and close the exterior cover, and a second handle, usable to open and close the cover member, respectively provided in respective positions at which the exterior cover located in the position where the exterior cover covers the sheet conveying unit and the cover member located in the closed position are opposed to each other.

16. The sheet feeding device of claim 15, wherein the sheet conveying unit includes a conveying member, arranged in the center of the sheet conveying unit in a width direction perpendicular to the sheet feeding direction, to convey sheets by separating one by one from the sheets, and the second handle of the cover member is provided with a concave portion in which a finger of a user is insertable, a bottom surface of the concave portion being inclined toward a side of the sheet conveying unit when the cover member is in the closed position.

17. The sheet feeding device of claim 11, wherein on at least one of portions of the cover member to which a pair of the side fences come relatively closer when the cover member is in the closed position, a concave portion is formed for operation in which inserted finger of a user is insertable to operate and move a pair of the side fences.

18. A sheet feeding device comprising:

a tray main body, including a first mount surface on which a sheet to be fed in a direction is placeable; and a cover member, rotatably connected to an end of the tray main body on a side opposite to a sheet feeding side such that the cover member is rotationally movable between a closed position, where the cover member covers the first mount surface of the tray main body, and an open position, where the first mount surface of the tray main body is exposed, the cover member including a second mount surface on which a sheet to be fed is placeable over the first mount surface of the tray main body when cover member is in the open position, and an opening for sheet insertion which penetrates through from an upper surface of the cover member to a bottom surface of the cover member such that a sheet is insertable onto the first mount surface of the tray main body when the cover member is in the closed position, the cover member including another mount surface that supports part of the underside of a sheet inserted through the opening in an exposed part of the cover member between the end connected to the tray main body and the opening when the cover member is in the closed position.

19. A sheet feeding device comprising:

a tray main body, including a first mount surface on which a sheet to be fed in a direction is placeable; and a cover member, rotatably connected to an end of the tray main body on a side opposite to a sheet feeding side such that the cover member is rotationally movable between a closed position, where the cover member covers the first mount surface of the tray main body, and an open position, where the first mount surface of the tray main body is exposed, the cover member including a second mount surface on which a sheet to be fed is placeable over the first mount surface of the tray main body when cover member is in the open position, and an opening for sheet insertion which penetrates through from an upper surface of the cover member to a bottom surface of the cover member such that a sheet is insertable onto the first mount surface of the tray main body when the cover member is in the closed position, wherein the cover member includes a projecting portion to project toward the opening in the center of the cover member in a width direction, perpendicular to a sheet inserting direction, and wherein the projecting portion includes another mount surface to support the sheet when the cover member is in the open position.

20. A sheet feeding device comprising:

a tray main body, including a first mount surface on which a sheet to be fed in a direction is placeable; and a cover member, rotatably connected to an end of the tray main body on a side opposite to the sheet feeding side, such that the cover member is rotationally movable between a closed position, where the cover member covers the first mount surface of the tray main body, and an open position, where the first mount surface of the tray main body is exposed, the cover member including a second mount surface on which a sheet to be fed is placeable over the first mount surface of the tray when cover member is in the open position, an opening being included in the cover member for sheet insertion through which a sheet is insertable onto the first mount surface of the tray main body when the cover member is in the closed position; and a pair of side fences to control movement of a sheet mounted on the first mount surface of the tray main body in a width direction perpendicular to a sheet feeding direction, wherein the cover member is formed so that at least part of both a pair of the side fences are exposed when the cover member is in the closed position, wherein a pair of the side fences each include an upper guide part on an upper end thereof, the respective upper guide parts being configured to guide a sheet mounted on the first mount surface of the tray main body by pushing both ends of the sheet in the width direction from above, and wherein the cover member is formed so that the respective upper guide parts of a pair of the side fences are exposed.

* * * * *